US005991562A

United States Patent [19]

Ito et al.

[11] Patent Number: 5,991,562

[45] Date of Patent: Nov. 23, 1999

[54] FIXING DEVICE, AND RELEASING AGENT REPLENISHING DEVICE AND METHOD FOR USE IN THE FIXING DEVICE

[75] Inventors: Tetsuro Ito, Anjo; Shigeo Honma, Toyohashi; Mitsuru Isogai, Aichi-Ken, all of Japan

[73] Assignee: Minolta Co., Ltd., Osaka, Japan

[21] Appl. No.: 09/157,316

[22] Filed: Sep. 21, 1998

[30] Foreign Application Priority Data

Sep. 22, 1997 [JP] Japan ..... 9-257058

[51] Int. Cl.[6] ..... G03G 15/20

[52] U.S. Cl. ..... 399/67; 399/325

[58] Field of Search ..... 399/67, 324, 325, 399/326

[56] References Cited

U.S. PATENT DOCUMENTS 4,193,681 3/1980 Tanigawa et al. .

5,353,107 10/1994 Sculley et al. ..... 399/43

FOREIGN PATENT DOCUMENTS 60-151680 8/1985 Japan .

2-73388 3/1990 Japan .

05265346 10/1993 Japan .

*Primary Examiner*—Joan Pendegrass

*Attorney, Agent, or Firm*—McDermott, Will & Emery

[57] ABSTRACT

In a fixing device with a fixing roller that fixes the toner held on a sheet, a pressuring roller that contacts with the fixing roller, and a supply roller that applies the oil to the fixing roller, image noises and offset phenomenon are prevented by replenishing the consumed oil immediately to the supply roller only when the fixing roller is rotating, based on the oil replenishing speed determined by the rotational speed of the fixing roller and the oil replenishing amount determined by the total rotation time of the fixing roller.

22 Claims, 13 Drawing Sheets

FIXING DEVICE, AND RELEASING AGENT REPLENISHING DEVICE AND METHOD FOR USE IN THE FIXING DEVICE

BACKGROUND OF THE INVENTION

1. Field of the Invention

The present invention relates to a fixing device for thermally fixing an unfixed image on a recording medium, and a device and a method for replenishing a releasing agent for use in the fixing device.

2. Description of the Related Art

An image forming apparatus such as an electrophotographic printer, copying machine, is normally equipped with a fixing device that fixes an unfixed toner image on a sheet as recording medium based on the pressure-thermal fixing process.

In such a fixing device, the sheet surface that retains the toner comes in direct contact with the surface of the fixing roller. As a result, it often causes a phenomenon called "offset" because unfixed toner on the sheet smears the fixing roller.

The offset phenomenon has been dealt with coating the surface of the fixing roller by means of a releasing agent coating mechanism with a releasing agent that helps to release the toner from the fixing roller smoothly, and maintaining the surface of the fixing roller clean using a cleaning roller and the like. Since silicon oil is normally used as the releasing agent, the releasing agent will be also called the "oil" in the following discussion for the sake of convenience.

The function of the releasing agent coating mechanism is to apply the oil to the surface of the fixing roller adequately as the oil is taken away by the sheet from the fixing roller surface each time the sheet passes the roller, or when the printing paper feed occurs. Consequently, the releasing agent coating mechanism is also referred to as the oil replenishing mechanism.

An oil replenishing mechanism of the prior art is disclosed in the Japanese Patent Unexamined Publication, JP-A-60-151680. The oil replenishing mechanism includes a cylindrical part, which has multiple small holes and holds the oil internally, a heat resistant porous elastic part that covers the outside of the cylindrical part, and an oil replenishing roller coated with a silicon varnish thin film that covers the outside surface of the heat resistant elastic part.

However, such an oil replenishing mechanism has a shortcoming that there is a limit to the amount of oil it can hold inside the cylindrical part, so that it has only a short life as an oil replenishing device.

Another Japanese Patent Unexamined Publication, No. P-A-05-265346, discloses an oil replenishing mechanism that improves the shortcoming described above. The oil replenishing mechanism comprises: an oil coating roller that holds the oil inside, is in contact with the fixing roller under a pressure to be driven by the latter, and coats the fixing roller surface with the oil seeping out from the inside of the coating roller; and an oil replenishing device that replenishes the oil inside the coating roller from an external source; where the coating roller and the replenishing device are combined into a single sealed unit.

However, it is difficult to make the oil exist in a stable manner inside the coating roller of such an oil replenishing mechanism. Also, the coating roller has another shortcoming that its coating action is sometimes not uniform because it makes starts and stops repeatedly. In particular, the oil tends to gather at the lower portion of the coating roller due to the gravity when the coating roller is at still.

If the fixing roller is coated under such a condition, the oil seeping amount becomes uneven and hence the coating of the oil becomes uneven around the periphery of the fixing roller. Consequently, the offset phenomenon cannot be completely eliminated with such devices or mechanisms. The offset phenomenon is more conspicuously on a device or apparatus that handles color images, causes uneven luster and image noises.

SUMMARY OF THE INVENTION

The purpose of the invention is to prevent image noises.

An aspect of the present invention is a fixing device for thermally fixing an unfixed image on a recording medium by passing the recording medium carrying the unfixed image between a rotating member and a pressuring member that is in contact with the rotating member under pressure by means of rotation of the rotating member, the fixing device comprising: a supplying unit that supplies a releasing agent to the rotating member: a replenishing mechanism that replenishes the releasing agent to the supplying unit; and a controller that controls a releasing agent replenishing amount of the replenishing mechanism based on rotating operation of the rotating member.

An aspect of the present invention is a releasing agent replenishing device for use in a fixing apparatus for thermally fixing an unfixed image on a recording medium by passing the recording medium carrying the unfixed image between a rotating member and a pressuring member that is in contact with the rotating member under pressure by means of rotation of the rotating member, the device comprising: a supplying unit that supplies releasing agent to the rotating member: a replenishing mechanism that replenishes the releasing agent to the supplying unit; and a controller that controls a releasing agent replenishing amount of the replenishing mechanism based on rotating operation of the rotating member.

An aspect of the present invention is a method of replenishing a releasing agent to a supplying unit that supplies the releasing agent to a rotating member for use in a fixing apparatus for thermally fixing an unfixed image on a recording medium by passing the recording medium carrying the unfixed image between the rotating member and a pressuring member that is in contact with the rotating member under pressure by means of rotation of the rotating member, the method comprising the steps of: detecting rotational speed of the rotating member; detecting total rotation time or total rotation count of the rotating member; and controlling releasing agent replenishing speed based on detected rotational speed of the rotating member as well as releasing agent replenishing amount based on detected total rotation time or detected total rotation count of the rotating member.

The objects, features, and characteristics of this invention other than those set forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

Figure 1:
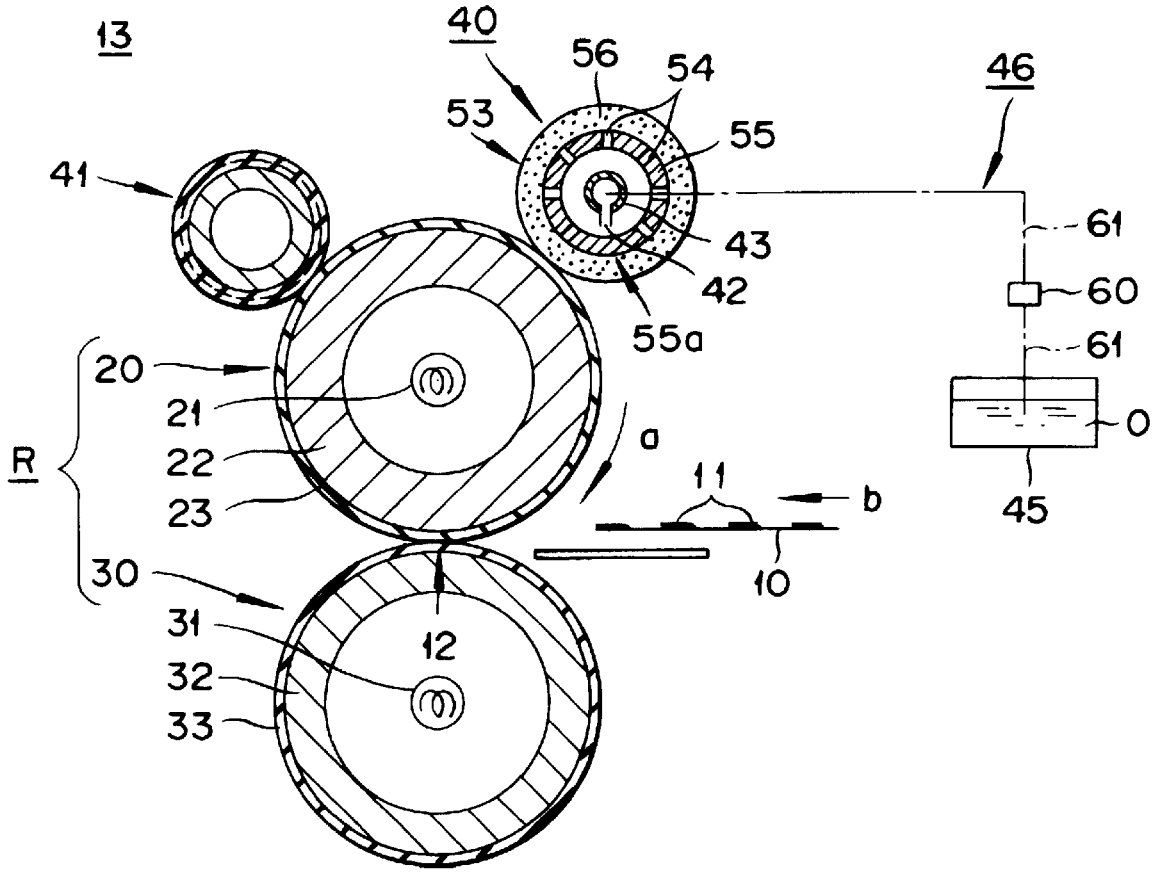
FIG. 1 is a schematic constitutional view of a fixing device according to a first embodiment of the invention.

A fixing device 13 shown in FIG. 1 is based on the pressure-thermal fixing process, and is built into and used as a part of an image forming apparatus such as a printer equipped with a known image forming device based on an electrophotographic process. The fixing device 13 comprises a fixing roller 20, a pressuring roller 30, a tubular heaters 21 and 31, and an oil coating mechanism 40.

The fixing roller 20 is provided in such a way that it can rotate in a direction indicated by an arrow "a." The pressuring roller 30 is provided in such a way that it contacts the fixing roller 20 as a pair under a pressure, and is driven by the fixing roller 20. The tubular heaters 21 and 31 heat the fixing roller 20 and the pressuring roller 30. The oil coating mechanism 40 coats at least one of the rollers (the fixing roller 20 in the drawing) with releasing agent O to prevent the offset phenomenon. The oil coating mechanism 40 comprises a transportation device 46 that properly transports the releasing agent O and an oil coating device 53.

The fixing roller 20 and the pressuring roller 30 represent a set of rolling members R that sets toner 11 held on a sheet 10 under heat and pressure. Silicon oil is used as the releasing agent O. The figure also shows a cleaning roller 41 that is covered with a fabric layer.

The fixing roller 20 comprises a hollow metal pipe 22 and a releasing layer 23 formed on the outer periphery thereof. The releasing layer 23, which is made of a fluororesin, has an excellent releasing property to the toner and heat resistance. A halogen lamp (tubular heater) 21 is provided on the center shaft of the fixing roller 20. Also, a driving gear (not shown) is attached to one end of the fixing roller 20, which is driven by a drive source (not shown) such as a motor.

The pressuring roller 30 comprises a hollow metal pipe 32 and a silicon rubber layer 33 provided on the outer periphery thereof. A halogen lamp (tubular heater) 31 is provided on the center shaft of the pressuring roller 30. The pressuring roller 30 is pressed in a direction toward the fixing roller 20 by a spring (not shown). The silicon rubber layer 33 has a releasing property that helps to release the sheet 10 from its surface and a required heat resistance. If the halogen lamp 21 built into the fixing roller 20 provides a sufficient heat to fix the toner, the halogen lamp 31 of the pressuring roller 30 can be eliminated.

In fixing the toner with the constitution described above, first of all, a required voltage is applied on the halogen lamps 21, 31. The radiant heat supplied by the halogen lamps 21, 31 heats the outer surfaces of the fixing roller 20 and the pressuring roller 30 until they reach a proper temperature for fixing. At this point, the sheet 10 holding unfixed toner 11 is fed from the right side of FIG. 1 in the direction shown by an arrow "b" into a nip area 12, which is the contact area between the fixing roller 20 and the pressuring roller 30. The sheet 10 is transferred pinched in the nip area 12 under the heat from the fixing roller 20 and the pressuring roller 30 and the pressure applied from the pressuring roller 30. As a result, the unfixed toner 11 becomes fused or fixed on the sheet 10.

The toner 11 is held on the side of the sheet 10 that contacts the fixing roller 20. After leaving the nip area 12, the sheet 10 separates itself from the fixing roller 20 because of its resilience and the curvature of the fixing roller 20 and travels leftward in FIG. 1. After that, the sheet 10 is transferred by a discharge roller (not shown) and discharged on a discharge tray (not shown).

The coating device 53 of the oil coating mechanism 40 of the first embodiment comprises a hollow supply roller only. The oil supply roller 53 extends along the axial direction of the fixing roller 20 and supplies the oil O on its surface to the fixing roller 20 while it is being driven by the fixing roller 20.

Figure 2A:
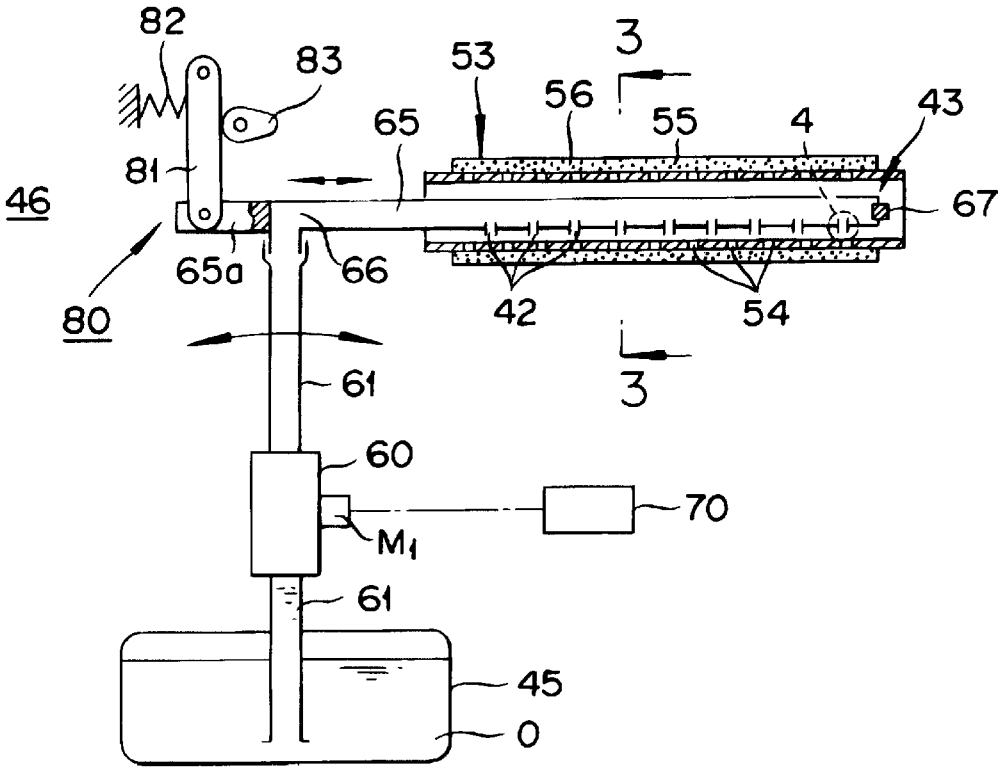
FIG. 2A is a schematic constitutional view that shows an oil transportation device.

As shown in FIG. 1 and FIG. 2A, the oil supply roller 53 consists of a cylindrical core 55 having a plurality of communicating holes 54 to cause the oil O to seep out to the outer layer, and an oil holding layer 56 covering the periphery of the cylindrical core 55.

The oil holding layer 56 is to hold the oil O temporarily to supply it to the fixing roller 20, and is made of a porous material that can be impregnated with oil, such as sponge, paper, felt and silicon rubber.

The center shaft of the supply roller 53 is provided with a supply nozzle 43, which is a part of the oil transportation device 46 to be described later, in a non-rotating manner. The oil O drips to the inside of the supply roller 53 from the supply nozzle 43.

The core 55 of the supply roller 53 is provided with a catch 55*a* to prevent the dripping oil O from seeping. The catch 55*a* extends in the axial direction of the supply roller 53. The communication holes 54 of the supply roller 53 are preferably provided at approximately uniform intervals on the entire periphery to communicate between the inner and outer surface of the core 55 in order to cause the oil O supplied from the supply nozzle 43 to seep out evenly to the outer layer. However, if the communicating holes 54 are provided on the entire surface, the offset phenomenon tends to occur more easily. It is because the oil O, which drips from the supply nozzle 43 and passes through the communicating holes 54, and the oil O, which is collected at the lower part of the oil holding layer 56 due to the gravity, may join together when the hollow roller is at still, thus creating an excessive accumulation of the oil O and causing dripping from the oil holding layer 56.

In the first embodiment, when the supply roller 53 stops, the oil catch 55*a* is positioned automatically to be always at the lowest position in the gravity direction by means of a position adjustment device 58. As a result, the oil O dripping from the supply nozzle 43 is held by the catch 55*a* and the amount of oil transmitted through the communication holes 54 to the oil holding layer 56 is reduced.

Figure 3:
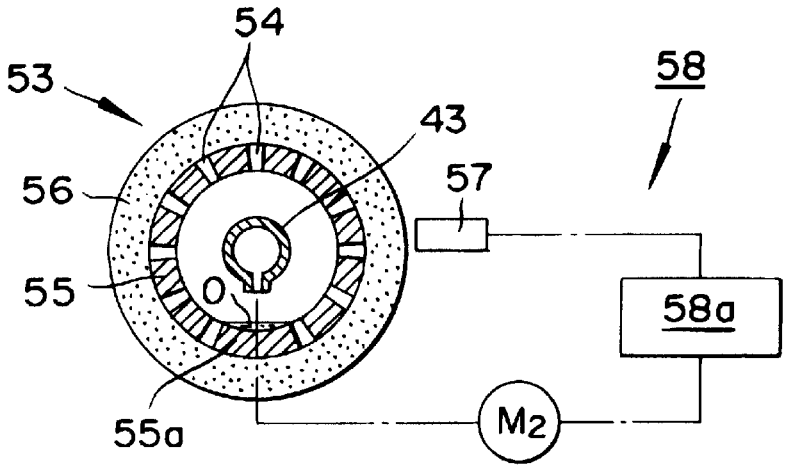
FIG. 3 is a cross-sectional explanatory drawing taken along a line 3—3 of FIG. 2.

The position adjustment device 58 comprises, as shown in FIG. 3, a position detecting device 57 that detects the position of the catch 55*a* of the supply roller 53; a motor M2 that drives the supply roller 53; and a control unit 58*a* that controls the rotation of a motor M2 based on signals from the position detecting device 57, controls the stop position of the supply roller 53, and adjusts the oil catch 55*a* so that it is always at the lowest position in the gravity direction.

Figure 4:
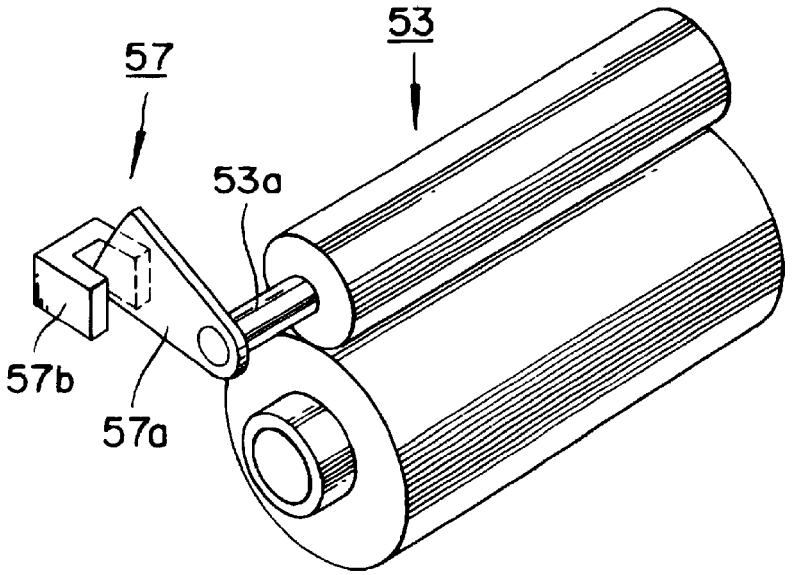
FIG. 4 is a perspective view of major components showing position adjustment device.

The position detecting device 57 preferably comprises, as shown in FIG. 4, a position detection plate 57*a*, which is attached to and rotates synchronously with a rotating shaft 53*a*, which is protruding from the end plate of the supply roller 53; and a sensor 57*b*, which is provided to detect the position of the detection plate 57*a* when the catch 55*a* is placed at the lowest position in the direction of the gravity.

The transportation device 46 of the oil coating mechanism 40 comprises, as shown in FIG. 2A, a supply nozzle 43 that is provided within the supporting roller 53 at a fixed position to supply the oil O through multiple spouts 42 into the supply roller 53; a sealed oil tank 45 that holds the oil O; an oil pump 60 that feeds the oil O from the oil tank 45 to the supply nozzle 43; a tube 61 that communicates with the oil tank 45, the oil pump 60 and the supply nozzle 43; a control unit 70 that controls the motor M1 of the oil pump 60.

The supply nozzle 43 comprises a pipe 65 made of stainless steel. On one end of the pipe 65 is located a supply hole 66 that is connected with the flexible tube 61. The other end of the pipe 65 is closed by the stop 67. In the middle of the pipe 65, the multiple spouts 42 are provided.

Figure 2B:
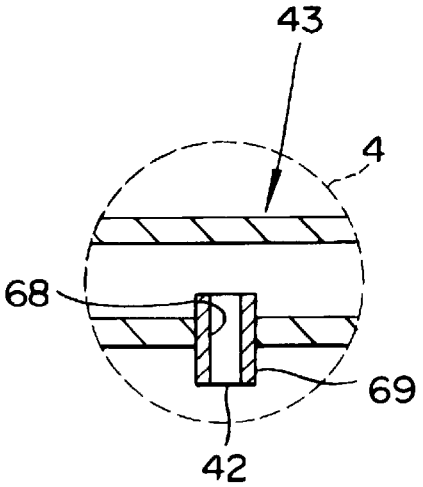
FIG. 2B is an enlarged view of an oil ejecting part of the oil transportation device.

As shown in FIG. 2B, spouts 42 are made by piercing multiple holes 68 at a fixed pitch along the pipe 65 and attaching a tube 69 made of stainless steel and having a diameter approximately equal to that of the hole to each hole 68 so that the oil can be spouted evenly.

With such a constitution, the diameters of holes 68 and tubes 69 are approximately the same along the lengthwise direction. Therefore, it is not necessary to increase the diameter of the pipe 65 even when the length of the nozzle is increased, thus making it possible to prevent the size of the oil coating mechanism 40 becoming too large. Moreover, since the sizes of the holes are approximately equal, the constitution of the spouts 42 remains relatively simple. Thus, it contributes to the realization of a lower manufacturing cost, and to a compact design and a lower overall cost of the fixing device 13.

Figure 5:
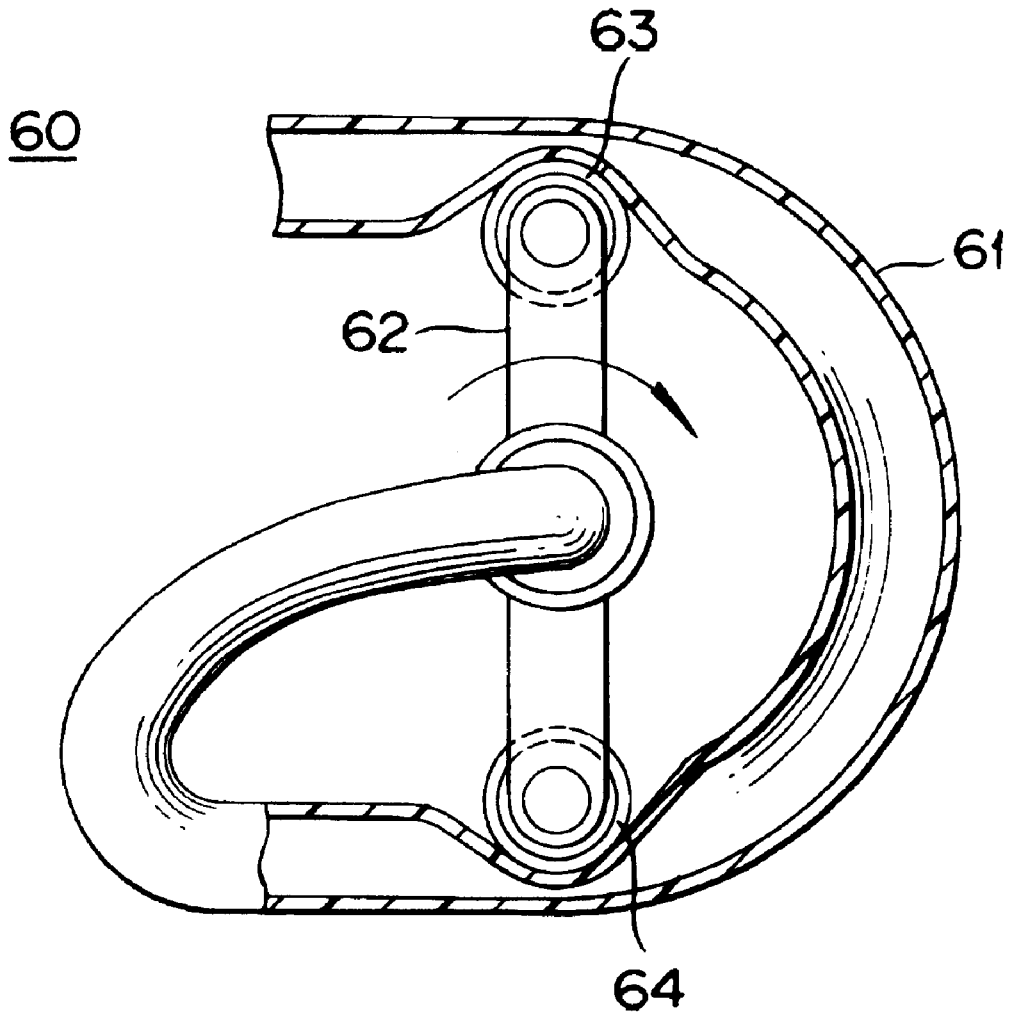
FIG. 5 is an outline explanatory drawing of an oil pump.

As shown in FIG. 5, the oil pump 60 preferably has two rollers 63 and 64, one at each end of a rotating plate 62, wherein the rollers 63 and 64 compresses the tube 61 to discharge a constant volume of the oil contained in the inside with each rotation. The oil tank 45 is preferably sealed so that a large amount of oil O can be stored regardless of vibrations or tilting of the oil tank 45.

In order to make the coating of the oil more uniform, it is preferable that the oil drips evenly from the inside of the supply roller 53 for the entire range. In order to accomplish it in the first embodiment, the entire supply nozzle 43 reciprocates axially by means of an axial transportation device 80.

In order to reciprocate the supply nozzle 43 axially, it is preferable that the axial transportation device 80 is constituted, as shown in FIG. 2A, in such a way that one end of a actuating link 81 is connected rotatably to an extension part 65*a* formed by extending the inlet side of the pipe 65; the other end of the actuating link 81 is attached to a fixed support rotatably; and the link 81 urged by a spring 82 is moved reciprocatingly by means of a cam 83.

Although the entire supply nozzle 43 is constituted in the first embodiment to reciprocate in the axial direction of the supply roller 53, it is also possible to constitute the supply nozzle 43 to have a telescopic structure where only a part of it moves axially.

The oil O is quickly squeezed out from the oil holding layer 56 onto the surface of the fixing roller 20 thus to be consumed, when the paper is fed, or when the fixing roller 20 rotates. Therefore, if the oil replenishing amount to the holding layer 56 is larger than necessary, the oil O drips from the oil holding layer 56 on the fixing roller 20 and causes oil streaks or the offset phenomenon in the restarting time. Moreover, if the oil replenishing amount to the oil holding layer 56 is too small, the fixing roller 20 does not get a sufficient amount of oil O and results in insufficient toner removal and poor releasing function.

Therefore, what is required in terms of the oil replenishing amount to the oil holding layer 56 is that an amount equivalent to the amount of oil consumed with the rotation of the supply roller 53 is replenished at a speed matching with the speed of consumption. If this is accomplished, an appropriate amount of oil always exists in the oil holding layer 56 so that no problem can occur due to an excessive or insufficient amount of oil and a normal operation can always be expected.

According to experiments, the amount of oil per sheet of paper 10 requires is 10 to 15 mg. This means 10 to 15 g of oil is required corresponding to 1000 sheets of paper.

Therefore, it is possible to determine the oil replenishing amount to the supply roller 53 based on the number of sheets passes. However, although this method can control the total amount of oil, it is difficult to control the amount and speed in a proper relation.

Here, the term "amount" represents the quantity of oil the fixing roller 20 consumes, which corresponds to the number of sheets, or the total rotation time and the total rotation count of the fixing roller 20. Also, the term "speed" is the speed of the fixing roller consumes the oil and corresponds to the rotational speed of the fixing roller 20.

Figure 6:
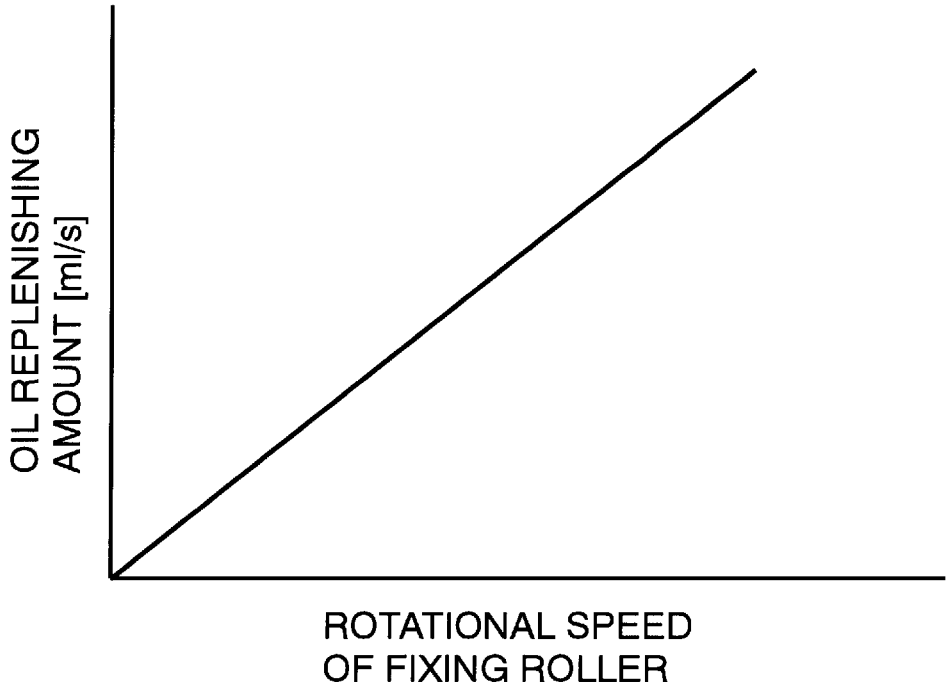
FIG. 6 is a graph showing the relation between the rotational speed of the fixing roller and the oil replenishing speed.
Figure 7:
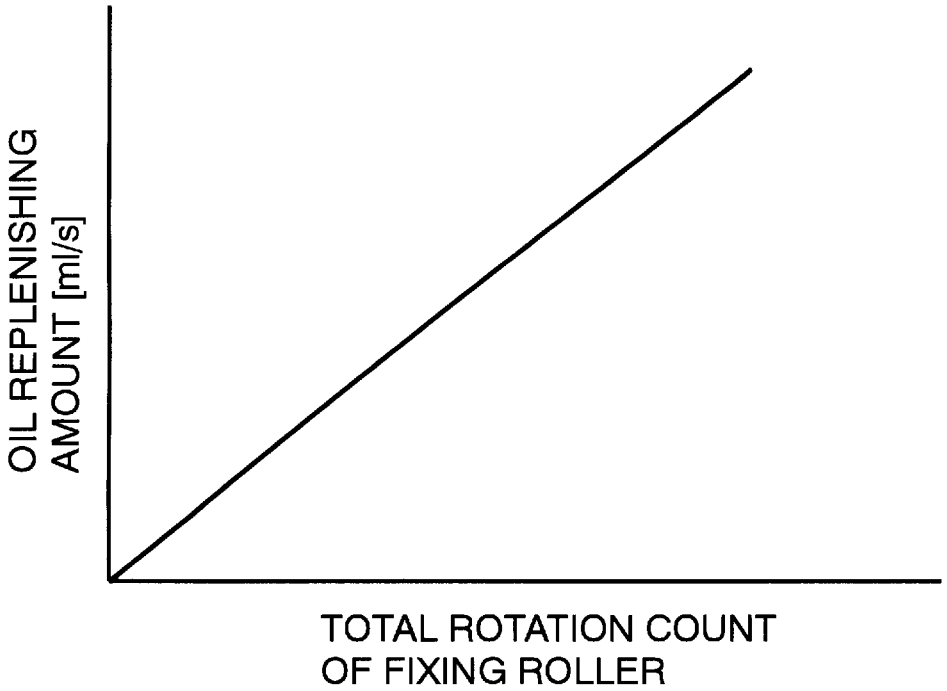
FIG. 7 is a graph showing the relation between the total rotation count of the fixing roller and the oil replenishing amount.
Figure 8:
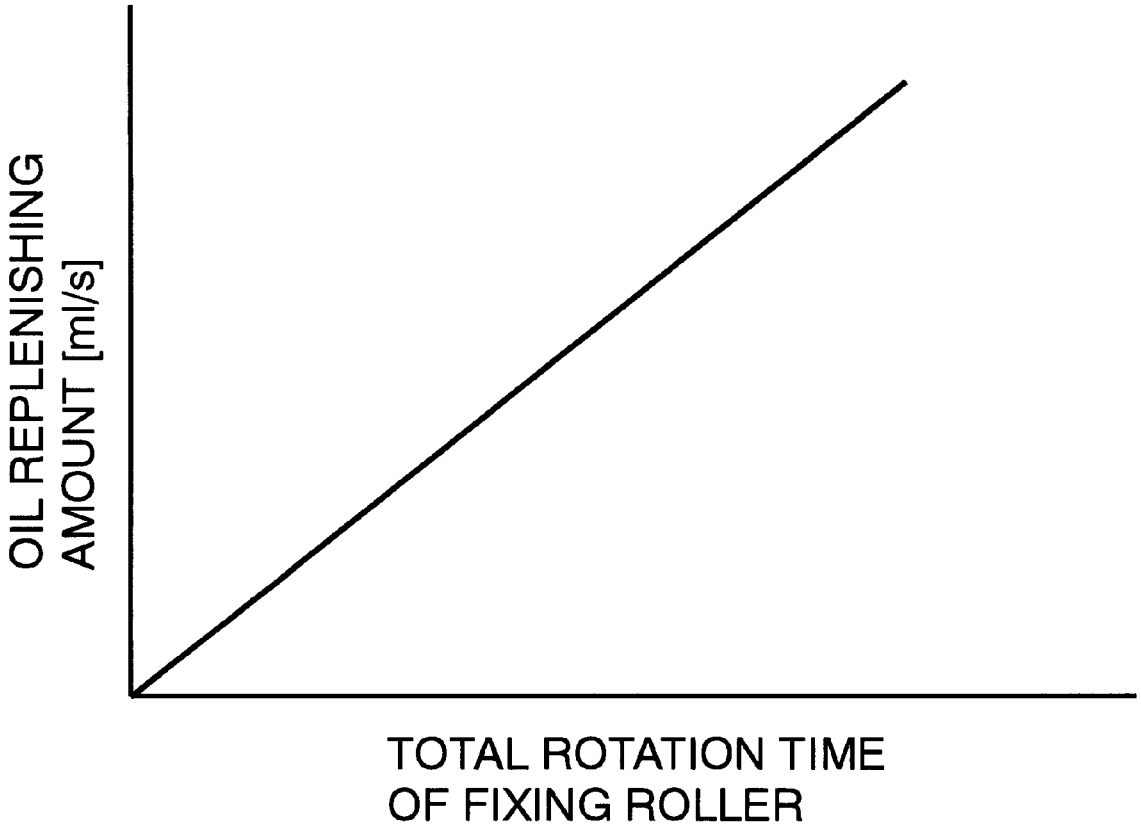
FIG. 8 is a graph showing the relation between the total rotation time of the fixing roller and the oil replenishing amount.

A study on the relation between the oil replenishing amount to the supply roller 53 and the rotational speed of the fixing roller 20 revealed that they have a linear relation as shown in FIG. 6. Also, a study on the relation between the oil replenishing amount and the total rotation time and the total rotation count of the fixing roller 20 revealed that they have linear relations as shown in FIGS. 7 and 8 respectively.

Therefore, it is possible to replenish a proper amount of oil at a proper replenishing speed to the supply roller 53, if the rotation of the motor M1 of the oil pump 60, which is the oil transportation device 46, is controlled by means of the control unit 70 based on the relations described above, while the fixing roller 20 is rotating and consuming the oil.

The action of the first embodiment is described below.

The oil O to be coated on the surface of the fixing roller 20 is pumped from the oil tank 45 by driving the pump 60 of the oil transportation device 46; transported to the supply nozzle 43 provided in the inside of the supply roller 53 via the tube 61; spouted by the spouts 42 as drops; pushed out through the oil holding layer 56 to the outside; and coated on the surface of the fixing roller 20. The oil supplied to the fixing roller 20 is controlled by the control unit 70 in terms of amount and speed during the rotation of the fixing roller 20.

Figure 9A:
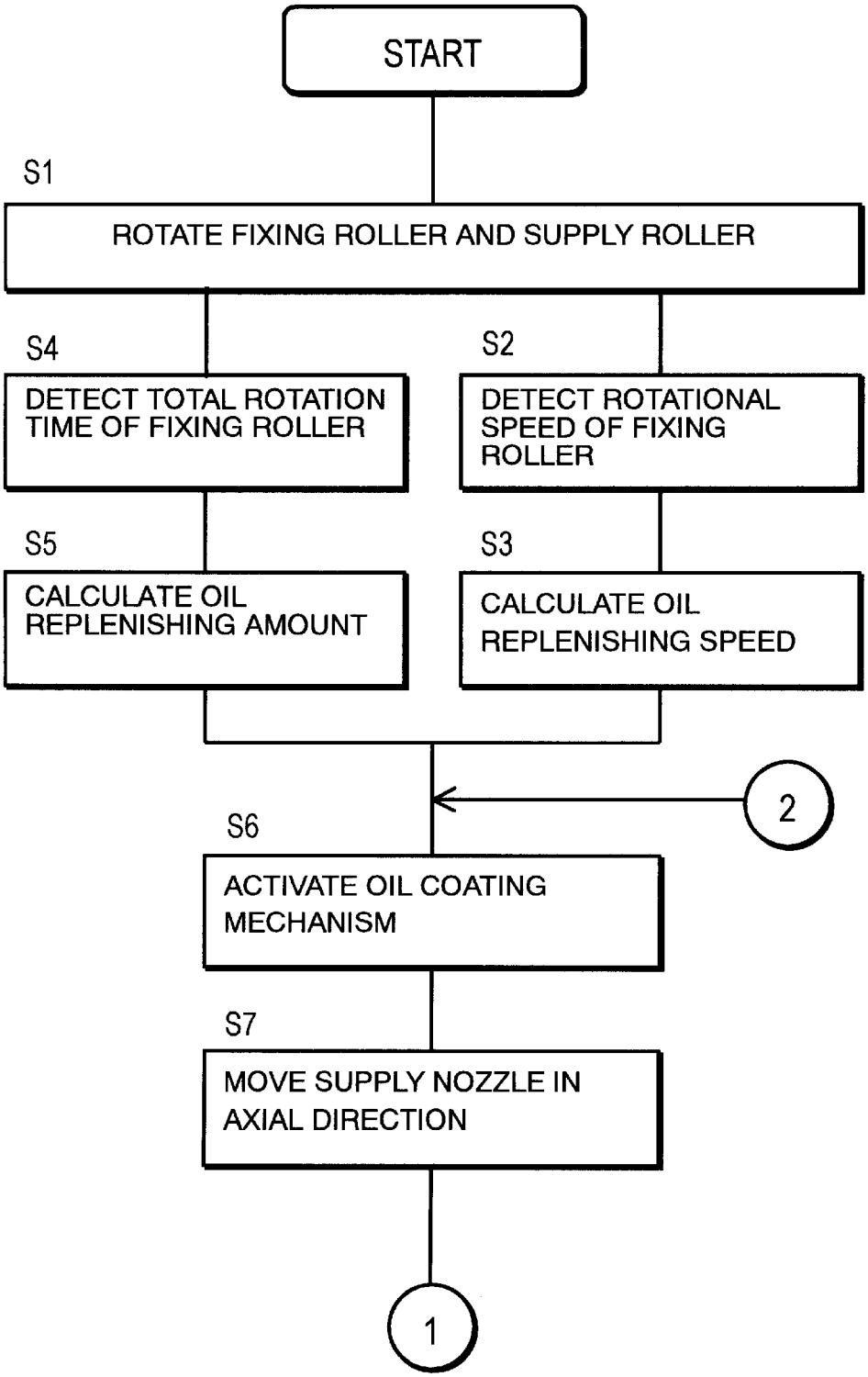
FIG. 9A and FIG. 9B are flow charts for explaining the oil replenishing action.
Figure 9B:
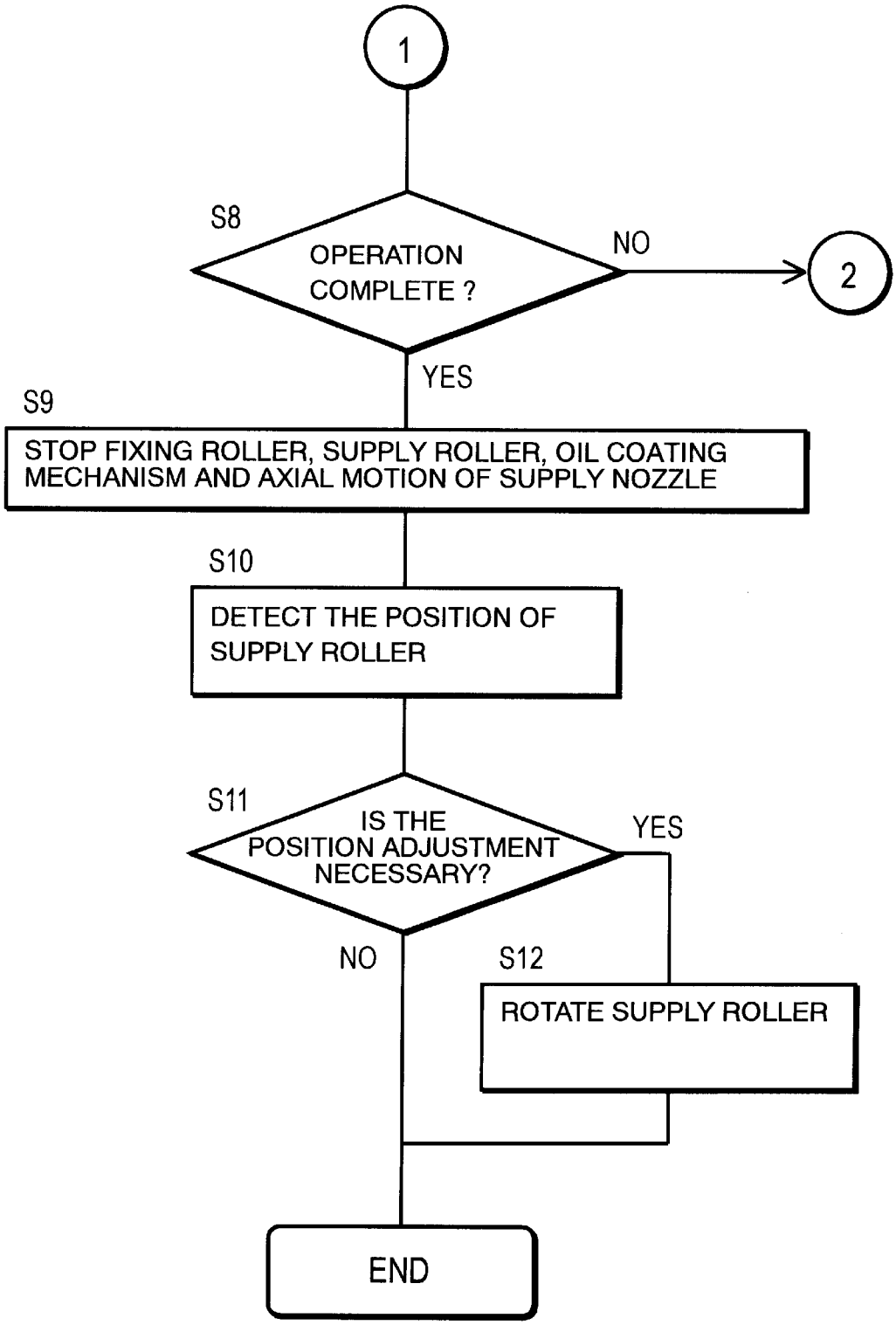

FIG. 9A and FIG. 9B are flow charts showing the oil replenishing action of the first embodiment.

In the first embodiment, the pressure roller 30 rotates driven by the fixing roller 20; the sheet 10 holding the toner 11 is fed through the rollers 20 and 30; the toner on the sheet 10 is fixed; and the supply roller 53 rotates driven by the motor M2 (Step 1).

In order to replenish the oil in response to the amount and speed of the oil consumed by the fixing roller 20 as the sheet is fed, the rotational speed of the fixing roller 20 is detected (Step 2), the oil replenishing speed is calculated (Step 3), the total rotation time of the fixing roller 20 is detected (Step 4), and the oil replenishing amount is calculated (Step 5). It is also possible to calculate the oil replenishing amount by means of detecting the total rotation count instead of the total rotation time of the fixing roller 20.

Next, the oil coating mechanism 40 is activated based on the calculated oil amount and speed (Step 6). The required amount of oil is replenished to the supply roller 53 at the required speed, as the oil transportation device 46 is activated and the motor M1 of the oil pump 60 rotates at the specified speed to feed the oil O to the oil holding layer 56 of the supply roller 53, and causing the oil to drip from the supply nozzle 43 to the oil holding layer 56. In this case, the dripping of the oil O from the supply nozzle 43 is formed as droplets. However, since the spouts 42 of the supply nozzle 43 have openings with a uniform diameter and are arranged at specified intervals, the amount of oil spouted from each spout 42 is equal so that the oil spreads out in a plane as it is absorbed by the oil holding layer 56.

Moreover, the axial transportation device 80 is activated during the oil replenishment process (Step 7). As a result, the supply nozzle 43 is axially moved to coat the oil O in almost the entire range of the supply roller 53 to let the oil seep out to the oil holding layer 56 through the communicating holes 54. The toner attached to the surface of the fixing roller 20 is removed by the oil O and the action of the cleaning roller 41.

Next, a judgment is made whether the specified actions such as copying have been completed (Step 8). If the work is completed, the rotations of the fixing roller 20 and the supply roller 53 as well as the actions of the oil coating mechanism 40 and the axial transportation device 80 all stop (Step 9).

Furthermore, when the supply roller 53 stops to rotate, the oil O held in the oil holding layer 56 tends to accumulated to the lower section of the oil holding layer 56 due to the gravity. In case of the first embodiment, however, the catch 55*a* holds the oil O dripping from the supply nozzle 43. Thus, the oil O that gathers in the lower section of the oil holding layer 56 is reduced, and the offset phenomenon is prevented.

Next, the position of the catch 55*a* is detected by the position detecting device 57 (Step 10), and a judgment is made as to whether the position correction is needed (Step 11). If the position correction is needed, the motor M2 that drives the supply roller 53 is rotated slightly by means of the position adjustment device 58 to execute the correction action (Step 12). If the position correction is not necessary, the action ends.

Let us now describe alternative embodiments referring to FIGS. 10 through 14. The parts or devices appearing in FIGS. 10 through 14 that are in common with FIGS. 1, 2A and 2B are identified with the same codes.

Figure 10:
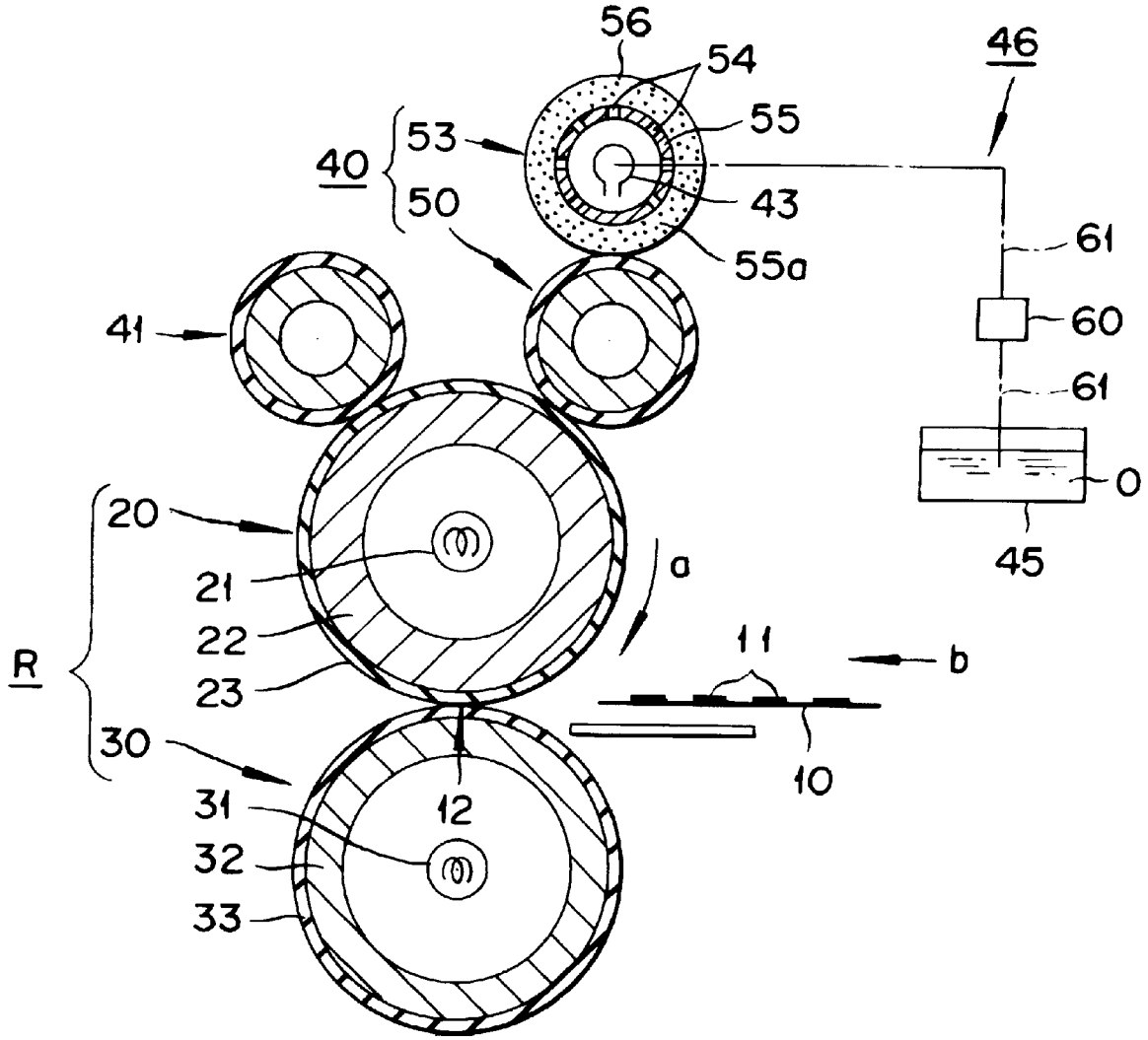
FIG. 10 is a schematic constitutional view showing a fixing device according to the second embodiment.

FIG. 10 is a schematic constitutional view showing a fixing device according to the second embodiment.

The key point of the second embodiment is an improvement of the evenness of oil coating on the fixing roller 20.

In the first embodiment, the coating device 53 of the oil coating mechanism 40 is accomplished by direct contact of the hollow supply roller on the fixing roller 20. In the second embodiment, however, in order to coat the oil more evenly on the fixing roller 20, the oil from the supply roller 53 is applied to the fixing roller 20 via an oil coating roller 50. This coating roller 50 comprises a silicon rubber layer provided on the periphery of a hollow metal pipe.

Figure 11:
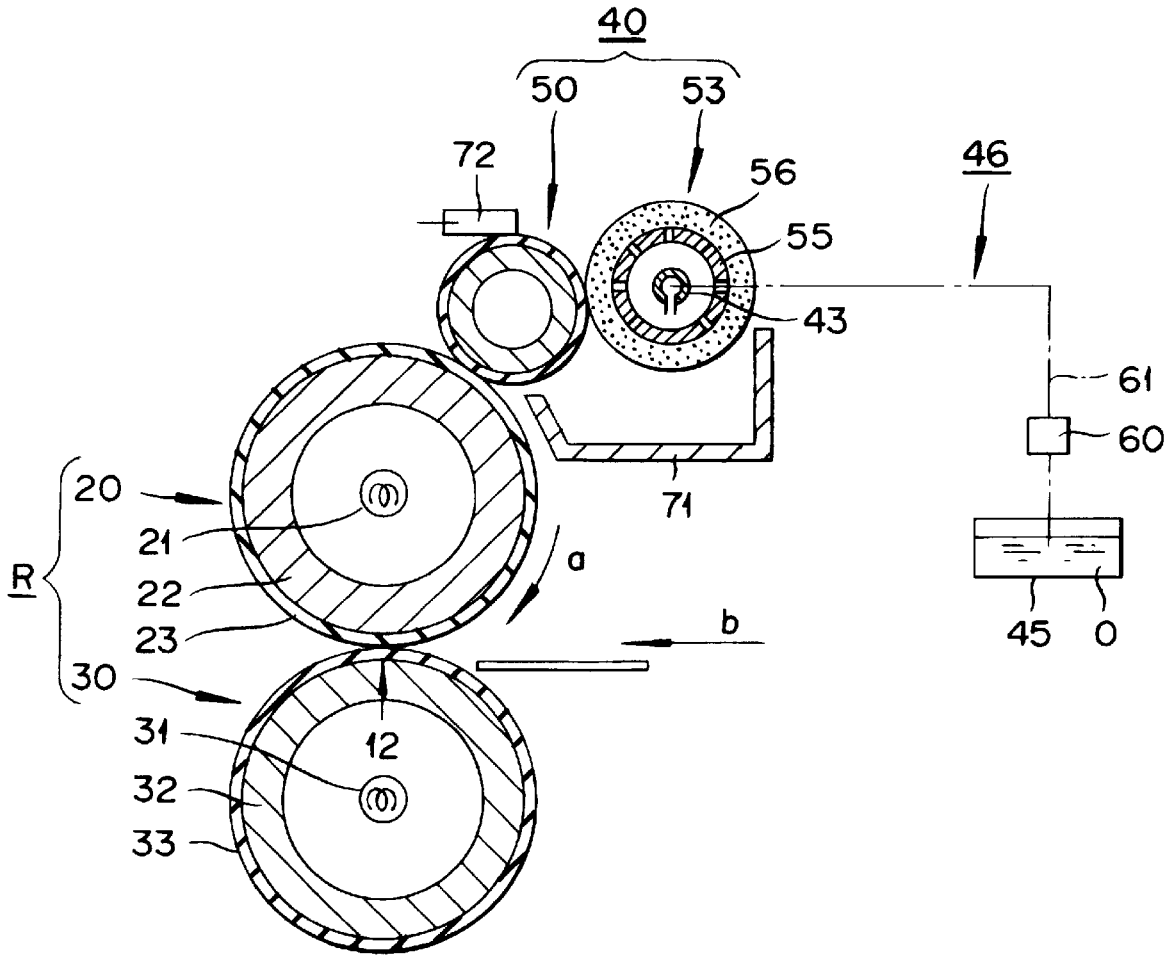
FIG. 11 is a schematic constitutional view showing a fixing device according to the third embodiment.

FIG. 11 is a schematic constitutional view showing a fixing device according to the third embodiment. The key point of the third embodiment is an improvement of the reliability.

The advantage of the first embodiment is that, since only the consumed oil is replenished, there is no oil leakage or dripping from the oil holding layer 56 and no need for providing an oil pan beneath the supply roller 53, so that the constitution of the apparatus can be simplified. However, in the third embodiment, in order to improve the reliability, an oil pan 71 is provided underneath the feed roller 53, and also an oil restricting blade 72 is provided having a length approximately equal to the axial length of the coating roller 50 in order to scrape away the oil that was not coated on the fixing roller 20, so that the oil O that is removed by the restricting blade 72 can be caught by the oil pan 71.

Figure 12:
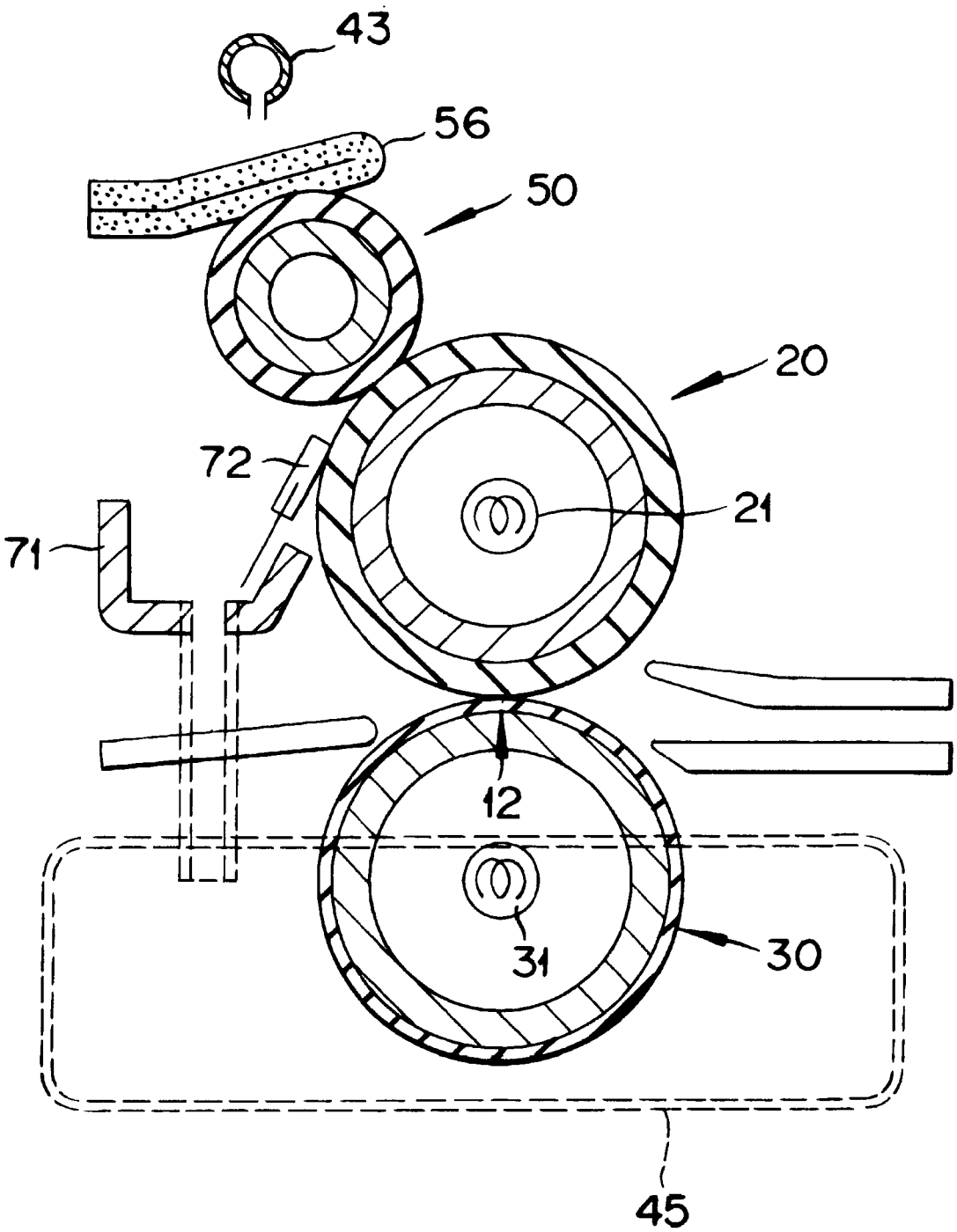
FIG. 12 is a schematic constitutional view showing a fixing device according to the fourth embodiment.

FIG. 12 is a schematic constitutional view showing a fixing device according to the fourth embodiment. The key point of the fourth embodiment is that it provides an alternative design for the oil coating mechanism.

In the first embodiment, the coating device 53 of the oil coating mechanism 40 comprises the oil holding layer 56 provided on the periphery of the supply roller 53. However, other alternative designs are possible. As shown in FIG. 12, a simple sponge mat abutting the coating roller 50 directly can be used as the oil holding layer 56.

Figure 13:
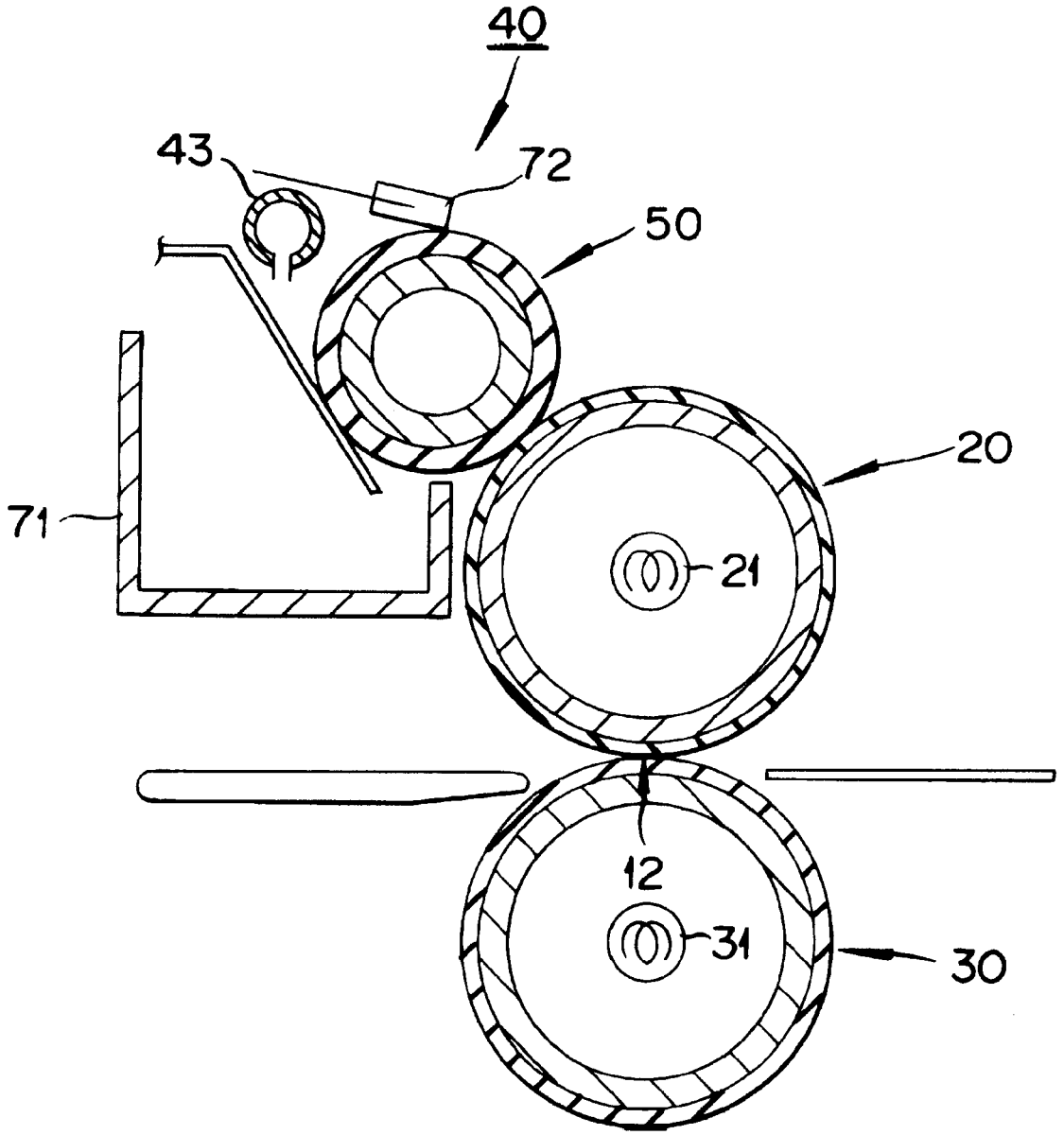
FIG. 13 is a schematic constitutional view showing a fixing device according to the fifth embodiment.

FIG. 13 is a schematic constitutional view showing a fixing device according to the fifth embodiment. The fifth embodiment also presents an alternative design for the oil coating mechanism.

The coating device 53 in the first, second and third embodiments, have the oil holding layer 56. However, the oil holding layer 56 is not necessarily required. In the coating mechanism of the fifth embodiment, the oil is applied directly to the coating roller 50 that is contacting the fixing roller 20 under a pressure. As long as the consumed oil is accurately replenished, there is no problem.

Figure 14:
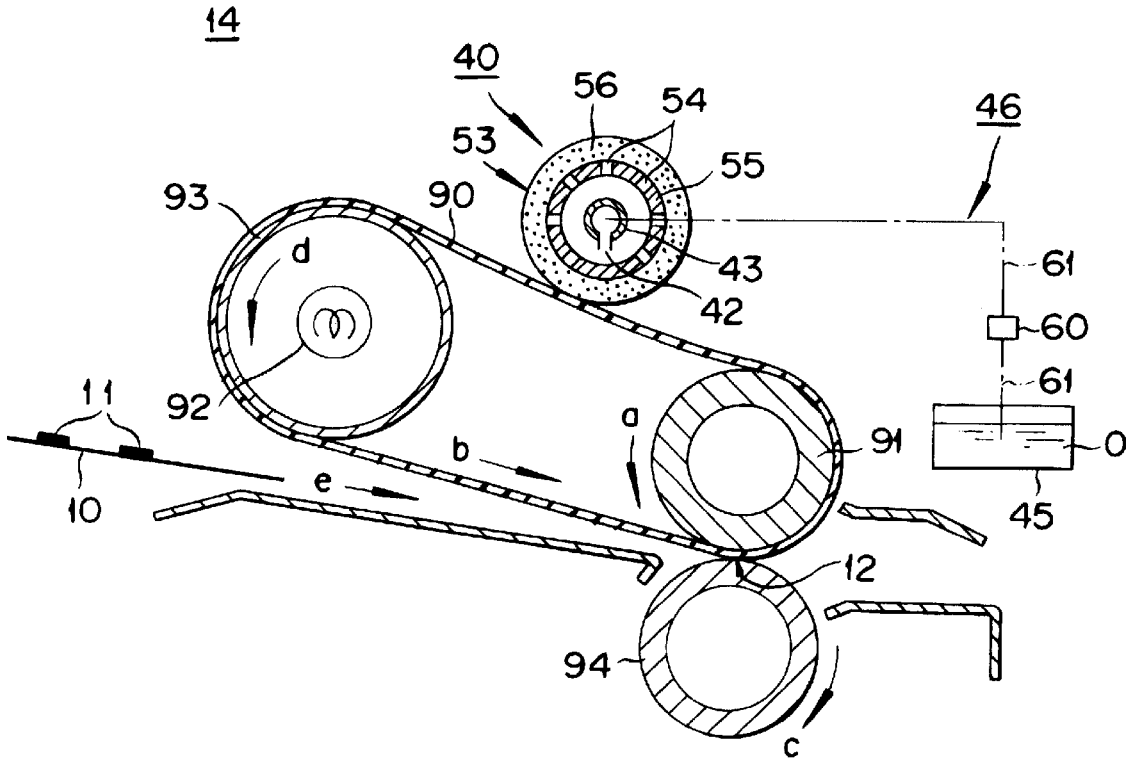
FIG. 14 is a schematic constitutional view showing a fixing device according to the sixth embodiment.

FIG. 14 is a schematic constitutional view showing a fixing device 14 according to the sixth embodiment. The key point of the sixth embodiment is that the fixing device 14 is based on a belt fixing process.

In the descriptions of all of the embodiments so far, from the first through fifth embodiments, the fixing device is based on the roller fixing process. However, the present invention can be applied to other fixing processes. For example, as shown in FIG. 14, the invention can be applied to the fixing device 14 based on the belt fixing process, wherein the releasing agent (oil) is supplied to a heating belt 90 that constitutes the rotary member R.

Next, let us describe the outline of the fixing device 14.

As shown, the fixing device 14 comprises a drive roller 91 provided in such a manner as to make it possible to rotate in the direction of the arrow "a", a heating roller 93 that encloses a tubular heater or a halogen lamp 92, the heating belt 90 that runs between the drive roller 91 and the heating roller 93, and a pressuring roller 94 as a pressuring device, which is in contact with the drive roller 91 via the heat belt 90. The oil coating mechanism 40 is placed above the heating belt 90, and the coating device 53 is in contact with the heating belt 90.

The heating belt 90 is a thin, preferably a seamless, belt comprising a base material made of either a carbon steel, stainless steel, nicker or a heat-resistant resin, and a surface layer having a good releasing property and heat resistance. The drive roller 91 moves the heating belt 90 in the direction of the arrow "b" as it makes contact with the backside of the heating belt 90.

In order to make sure that the heating belt is driven properly, the periphery of the drive roller 91 is covered with a material of a high friction coefficient such as silicon rubber, so that no slippage occur between it and the heating belt 90. The heating roller 93 is preferably made of a material with a high thermal conductivity, such as aluminum and copper, in order to transmit heat to the heating belt 90 effectively. The heating roller 94 comprises a layer of silicon rubber or polytetrafluoroethylene resin coated on a metal pipe and makes contact with the drive roller 91 and the heating roller 93 via the heating belt 90 urged by a spring (not shown). It is also possible to provide another halogen lamp on the center shaft of the pressuring roller 94.

As the heating belt 90 moves in the direction of the arrow "b" in accordance with the rotation of the drive roller 91, the pressuring roller 94 rotates in the direction of the arrow "c" driven by the friction force between it and the heating belt 90, and the heating roller 93 also rotates in the direction of the arrow "d". It can also have a constitution wherein the pressuring roller 94 is driven independently to match the travelling speed of the heating belt 90.

The travelling heating belt 90 is not only coated with the oil O by means of the coating device 53 of the oil coating mechanism 40, but also is heated to a specified temperature by the heat from the halogen lamp 92 in the contact area between it and the heating roller 93, and proceeds to the nip area 12 between it and the pressuring roller 94.

The sheet 10 holding the unfixed toner 11 on the side that makes contact with the heating belt 90 is transported in the direction of the arrow "e" toward the nipping area 12 being guided by the guide plate. As the sheet 10 enters the nipping area 12, it is amply heated by the heating belt 90, with which it makes contact, while it is transported being pinched in the nipping area 12 receiving pressures from the pressuring roller 94 and the rollers 91, 93. As a result, the unfixed toner 11 on the sheet 10 fuses as it is amply heated, pressed and consequently fixed on the sheet 10. The transfer of the toner to the heating belt 90, or the offset phenomenon is suppressed due to the releasing agent coated on the heating belt 90.

A described in the above, the releasing agent can be coated without causing the offset phenomenon and with assurance of a uniform coating if the releasing agent supplied to the rotating member is replenished properly in terms of both the amount and speed. As a result, the generation of image noises can be prevented. Moreover, if the releasing agent to be supplied to the rotating member is temporarily held in the releasing agent holding layer provided on the periphery of the hollow roller before it is transferred to the rotating member, the oil coating becomes more uniform and stable. If the releasing agent supply nozzle in the hollow roller is constituted in such a manner as to make it able to move axially, the oil coating becomes further uniform and stable. Furthermore, by providing a catch in the cores of the hollow roller having communicating holes to prevent the seeping of the oil, and maintaining the catch always at the lowest position in the direction of the gravity, the oil seeping amount can be reduced to prevent the offset phenomenon more securely.

It is obvious that this invention is not limited to the particular embodiments shown and described above but may be variously changed and modified without departing from the technical concept of this invention. Further, the entire disclosure of Japanese Patent Application No. 09-257058 filed on Sep. 22, 1997, including the specification, claims, drawings and summary are incorporated herein by reference in its entirety.

What is claimed is:

1. A fixing device for thermally fixing an unfixed image on a recording medium by passing the recording medium carrying the unfixed image between a rotating member and a pressuring member that is in contact with the rotating member under pressure by means of rotation of the rotating member, the fixing device comprising:

a supplying unit that supplies a releasing agent to the rotating member;

a replenishing mechanism that replenishes the releasing agent to said supplying unit; and a controller that controls a releasing agent replenishing amount of said replenishing mechanism based on the rotating speed of said rotating member, wherein said controller controls releasing agent replenishing speed based on rotational speed of said rotating member as well as the releasing agent replenishing amount based on total rotation time of said rotating member.

2. A fixing device according to claim 1, wherein said controller controls said replenishing mechanism to replenish the releasing agent only when said rotating member is rotating.

3. A fixing device according to claim 1, wherein said replenishing mechanism comprises a nozzle that replenishes the releasing agent to said supplying unit, a tank that stores the releasing agent, and a pump that transports the releasing agent stored in the tank to the nozzle.

4. A fixing device according to claim 3, wherein said supplying unit comprises a cylindrical core having multiple holes to supply the releasing agent and a catch to prevent the supply of the releasing agent, and a releasing agent holding layer covering a periphery of the cylindrical core, and supplies the releasing agent to said rotating member via the releasing agent holding layer as it rotates, said nozzle of said replenishing mechanism is placed inside the cylindrical core, and said controller controls the catch to be located at a lowest position in a gravity direction when said supplying unit stops to rotate.

5. A fixing device according to claim 3, wherein said supplying unit comprises a coating roller that is in contact with said rotating member to coat said rotating member with the releasing agent, and a supply roller that applies the releasing agent supplied from the nozzle to the coating roller.

6. A fixing device for thermally fixing an unfixed image on a recording medium by passing the recording medium carrying the unfixed image between a rotating member and a pressuring member that is in contact with the rotating member under pressure by means of rotation of the rotating member, the fixing device comprising.

a supplying unit that supplies a releasing agent to the rotating member;

a replenishing mechanism that replenishes the releasing agent to said supplying unit; and a controller that controls a releasing agent replenishing amount of said replenishing mechanism based on the rotating speed of said rotating member, wherein said controller controls releasing agent replenishing speed based on rotational speed of said rotating member as well as the releasing agent replenishing amount based on total rotation count of said rotating member.

7. A fixing device according to claim 6, wherein said controller controls said replenishing mechanism to replenish the releasing agent only when said rotating member is rotating.

8. A fixing device according to claim 6, wherein said replenishing mechanism comprises a nozzle that replenishes the releasing agent to said supplying unit, a tank that stores the releasing agent, and a pump that transports the releasing agent stored in the tank to the nozzle.

9. A fixing device according to claim 8, wherein said supplying unit comprises a cylindrical core having multiple holes to supply the releasing agent and a catch to prevent the supply of the releasing agent, and a releasing agent holding layer covering a periphery of the cylindrical core, and supplies the releasing agent to said rotating member via the releasing agent holding layer as it rotates, said nozzle of said replenishing mechanism is placed inside the cylindrical core, and said controller controls the catch to be located at a lowest position in a gravity direction when said supplying unit stops to rotate.

10. A fixing device according to claim 8, wherein said supplying unit comprises a coating roller that is in contact with said rotating member to coat said rotating member with the releasing agent, and a supply roller that applies the releasing agent supplied from the nozzle to the coating roller.

11. A releasing agent replenishing device for use in a fixing apparatus for thermally fixing an unfixed image on a recording medium by passing the recording medium carrying the unfixed image between a rotating member and a pressuring member that is in contact with the rotating member under pressure by means of rotation of the rotating member, the device comprising:

a supplying unit that supplies a releasing agent to the rotating member;

a replenishing mechanism that replenishes the releasing agent to said supplying unit; and a controller that controls a releasing agent replenishing amount of said replenishing mechanism based on the rotating speed of said rotating member, wherein said controller controls releasing agent replenishing speed based on rotational speed of said rotating member as well as the releasing agent replenishing amount based on total rotation time of said rotating member.

12. A releasing agent replenishing device according to claim 11, wherein said controller controls said replenishing mechanism to replenish the releasing agent only when said rotating member is rotating.

13. A releasing agent replenishing device according to claim 11, wherein said replenishing mechanism comprises a nozzle that replenishes the releasing agent to said supplying unit, a tank that stores the releasing agent, and a pump that transports the releasing agent stored in the tank to the nozzle.

14. A releasing agent replenishing device according to claim 13, wherein said supplying unit comprises a cylindrical core having multiple holes to supply the releasing agent and a catch to prevent the supply of the releasing agent, and a releasing agent holding layer covering a periphery of the cylindrical core, and supplies the releasing agent to said rotating member via the releasing agent holding layer as it rotates, said nozzle of said replenishing mechanism is placed inside the cylindrical core, and said controller controls the catch to be located at a lowest position in a gravity direction when said supplying unit stops to rotate.

15. A releasing agent replenishing device according to claim 13, wherein said supplying unit comprises a coating roller that is in contact with said rotating member to coat said rotating member with the releasing agent, and a supply roller that applies the releasing agent supplied from the nozzle to the coating roller.

16. A releasing agent replenishing device for use in a fixing apparatus for thermally fixing an unfixed image on a recording medium by passing the recording medium carrying the unfixed image between a rotating member and a pressuring member that is in contact with the rotating member under pressure by means of rotation of the rotating member, the device comprising:

a supplying unit that supplies a releasing agent to the rotating member;

a replenishing mechanism that replenishes the releasing agent to said supplying unit; and a controller that controls a releasing agent replenishing amount of said replenishing mechanism based on the rotating speed of said rotating member, wherein said controller controls releasing agent replenishing speed based on rotational speed of said rotating member as well as the releasing agent replenishing amount based on total rotation count of said rotating member.

17. A releasing agent replenishing device according to claim 16, wherein said controller controls said replenishing mechanism to replenish the releasing agent only when said rotating member is rotating.

18. A releasing agent replenishing device according to claim 16, wherein said replenishing mechanism comprises a nozzle that replenishes the releasing agent to said supplying unit, a tank that stores the releasing agent, and a pump that transports the releasing agent stored in the tank to the nozzle.

19. A releasing agent replenishing device according to claim 18, wherein said supplying unit comprises a cylindrical core having multiple holes to supply the releasing agent and a catch to prevent the supply of the releasing agent, and a releasing agent holding layer covering a periphery of the cylindrical core, and supplies the releasing agent to said rotating member via the releasing agent holding layer as it rotates, said nozzle of said replenishing mechanism is placed inside the cylindrical core, and said controller controls the catch to be located at a lowest position in a gravity direction when said supplying unit stops to rotate.

20. A releasing agent replenishing device according to claim 18, wherein said supplying unit comprises a coating roller that is in contact with said rotating member to coat said rotating member with the releasing agent, and a supply roller that applies the releasing agent supplied from the nozzle to the coating roller.

21. A method of replenishing a releasing agent to a supplying unit that applies the releasing agent to a rotating member for use in a fixing apparatus for thermally fixing an unfixed image on a recording medium by passing the recording medium carrying the unfixed image between the rotating member and a pressuring member that is in contact with the rotating member under pressure by means of rotation of the rotating member, the method comprising the steps of:

detecting rotational speed of the rotating member;

detecting total rotation time or total rotation count of the rotating member; and controlling releasing agent replenishing speed based on detected rotational speed of said rotating member as well as releasing agent replenishing amount based on detected total rotation time or detected total rotation count of the rotating member.

22. A method according to claim 21, wherein said releasing agent is so controlled as to be replenished only when the rotating member is rotating.

* * * * *